US009574373B2

(12) United States Patent
Ng

(10) Patent No.: US 9,574,373 B2
(45) Date of Patent: Feb. 21, 2017

(54) TWO-PRONG PADLOCK

(71) Applicant: Vastmax Corporation Limited, Kowloon (HK)

(72) Inventor: William Ng, Hong Kong (CN)

(73) Assignee: Vastmax Corporation Limited, Kowloon, Hong Kong (CN)

( * ) Notice: Subject to any disclaimer, the term of this patent is extended or adjusted under 35 U.S.C. 154(b) by 0 days.

(21) Appl. No.: 14/586,140

(22) Filed: Dec. 30, 2014

(65) Prior Publication Data

US 2016/0186466 A1 Jun. 30, 2016

(51) Int. Cl.

| | |
|---|---|
| ***E05B 27/06*** | (2006.01) |
| ***E05B 27/00*** | (2006.01) |
| ***E05B 27/08*** | (2006.01) |
| ***E05B 67/24*** | (2006.01) |
| ***E05B 67/28*** | (2006.01) |
| ***E05B 67/38*** | (2006.01) |
| *E05B 67/02* | (2006.01) |

(52) U.S. Cl.

CPC ..... *E05B 27/0089* (2013.01); *E05B 27/08* (2013.01); *E05B 67/24* (2013.01); *E05B 67/28* (2013.01); *E05B 67/38* (2013.01); *E05B 67/02* (2013.01)

(58) Field of Classification Search

CPC .. E05B 27/00; E05B 27/0017; E05B 27/0085; E05B 27/0089; E05B 27/0092; E05B 27/02; E05B 27/08; E05B 2047/10; E05B 67/00; E05B 67/02; E05B 67/22; E05B 67/24; E05B 67/28

USPC ..... 70/20, 31, 35, 38 R, 40, 41, 45, 48, 358

See application file for complete search history.

(56) References Cited

U.S. PATENT DOCUMENTS

| | | | | | |
|---|---|---|---|---|---|
| 1,003,331 | A * | 9/1911 | Caldwell | 70/40 | |
| 4,196,604 | A * | 4/1980 | Vorob | 70/358 | |
| 4,282,731 | A * | 8/1981 | Taksony | E05B 27/0064 | 70/419 |
| 4,358,943 | A * | 11/1982 | Ouellet | 70/358 | |
| 4,631,941 | A * | 12/1986 | Sjunnesson | E05B 27/0053 | 70/337 |
| 4,732,023 | A * | 3/1988 | Shen | 70/383 | |
| 5,000,019 | A * | 3/1991 | Foster | E05B 27/005 | 70/338 |
| 5,044,180 | A * | 9/1991 | Lebrecht | 70/48 | |
| 5,799,519 | A * | 9/1998 | Hsiao | E05B 27/001 | 70/358 |

(Continued)

OTHER PUBLICATIONS

Aug. 26, 2015—(US) Office Action—U.S. Appl. No. 14/795,468.

*Primary Examiner* — Christopher Boswell

(74) *Attorney, Agent, or Firm* — Banner & Witcoff, Ltd.

(57) ABSTRACT

The present disclosure discloses a padlock, comprising a lock cylinder and a lock housing. The lock cylinder is rotatable between a lock position and an unlock position with rotation of a key. The a lock housing comprises a sleeve shaped to fit with and for receiving the lock cylinder, a first prong extending outward from the sleeve and having a first recessed portion and a second prong extending outward from the sleeve and having a second recessed portion; wherein when the lock cylinder is rotated into the lock position/the unlock position, the through holes are aligned with the first recessed portion/the second recessed portion, the first pins/second pins are movable in the through holes and the first recessed portion/the second recessed portion, allowing the removal of the key from the keyhole.

8 Claims, 4 Drawing Sheets

(56) References Cited

U.S. PATENT DOCUMENTS

| | | | | |
|---|---|---|---|---|
| 5,921,123 | A * | 7/1999 | Schwarzkopf et al. | 70/371 |
| 6,519,988 | B1 * | 2/2003 | Wu | 70/358 |
| 7,426,842 | B2 * | 9/2008 | Hsieh | 70/358 |
| 8,347,660 | B2 * | 1/2013 | Guenther | 70/52 |

* cited by examiner

TWO-PRONG PADLOCK

TECHNICAL FIELD

The present disclosure generally relates to a padlock, and particularly relates to a two-prong padlock.

BACKGROUND

Padlocks are very widely used worldwide, due to their high security feature in self-storages, etc. Currently, various padlocks available in the markets would allow a key to be removed from the padlock when the padlock is locked, but the key cannot be removed from the padlock when the padlock is in an unlock position. However, when the padlock is in the unlock position with the key left in, especially when it is left on a floor or in an open area in storages, the padlock could be easily stepped on accidentally, causing the key to be broken and partially stuck inside the keyhole and hard to be removed without tools. As a result, the padlock is no longer functional with the broken key stuck inside. There is a growing expressed need from existing customers to conveniently remove the key not only when the padlock is in the lock position, but also in the unlock position.

SUMMARY

Objects of the present disclosure are to provide technical solutions for removing the key when the padlock is in both lock and unlock positions, which obviate at least one of the above-mentioned disadvantages.

According to the present disclosure, there is provided a padlock, comprising: a lock cylinder rotatable between a lock position and an unlock position with rotation of a key, comprising: a keyhole for receiving the key having a plurality of teeth; and one or more through holes extending from the keyhole to an outer surface of the lock cylinder for housing one or more first pins, respectively; wherein, when the key is in the keyhole, a proximal end of each first pin contacts with the tooth of the key, and a distal end of each first pin is at the outer surface of the lock cylinder; a lock housing, comprising: a sleeve shaped to fit with and for receiving the lock cylinder; a first prong extending outward from the sleeve and having a first recessed portion; wherein when the lock cylinder is rotated into the lock position, the through holes are aligned with the first recessed portion, the first pins are movable in the through holes and the first recessed portion, allowing the removal of the key from the keyhole; and a second prong extending outward from the sleeve and having a second recessed portion; wherein when the lock cylinder is rotated into the unlock position, the through holes are aligned with the second recessed portion, the first pins are movable in the through holes and the second recessed portion, allowing the removal of the key from the keyhole.

According to some embodiments of the present disclosure, the first prong and the second prong extend outward radically from the outer surface of the sleeve, respectively.

According to some embodiments of the present disclosure, an angle formed between the first prong and the second prong is about 120 degrees.

According to some embodiments of the present disclosure, the first prong and/or the second prong extend axially across an entire length of the sleeve.

According to some embodiments of the present disclosure, the first prong and/or the second prong extend axially across part of a length of the sleeve.

According to some embodiments of the present disclosure, the first recessed portion and the second recessed portion each comprising one or more holes for housing one or more second pins and one or more springs, respectively; wherein a distal end of each second pin contacts with the respective spring and a proximal end of each second pin contacts with the lock cylinder.

According to some embodiments of the present disclosure, the one or more through holes are 4 to 7 through holes; and the one or more first pins are 4 to 7 first pins.

According to some embodiments of the present disclosure, the one or more holes are 4 to 7 holes; the one or more second pins are 4 to 7 second pins; and the one or more springs are 4 to 7 springs.

According to some embodiments of the present disclosure, the distal end of each first pin is flat headed.

According to some embodiments of the present disclosure, the proximal end of each first pin is tapered.

In conclusion, various embodiments of the present disclosure provide a two-prong padlock with improved security and convenience, which allows the removal of the key in both lock position and unlock position, provides convenience to the users, reduces the possibility that the key is broken and stuck inside the padlock causing the padlock no long to be functional, improves the durability and reliability of the padlock, achieves high level of security and lowers the cost.

BRIEF DESCRIPTION OF THE DRAWINGS

The accompanying drawings are included to provide a further understanding of embodiments and constitute a part of this description. The drawings illustrate embodiments and together with the description serve to explain principles of embodiments. The elements of the drawings are not necessarily to scale relative to each other. Similar reference numerals designate corresponding similar parts. It should be expressly understood that the drawings are included for illustrative purposes and do not in any manner limit the scope of the present disclosure.

DETAILED DESCRIPTION

In the following description, for purposes of explanation rather than limitation, specific details, such as the particular architecture, structure, techniques, etc., are set forth for illustration. However, it will be apparent to those of ordinary skill in the art that other embodiments that depart from these specific details would still be understood to be within the scope of the present disclosure. Moreover, for the purpose of clarity, detailed descriptions of well-known devices, circuits, and methods are omitted so as not to obscure the description of the present disclosure. It is to be understood that the features of the various exemplary embodiments described herein may be combined with each other, unless specifically noted otherwise.

According to the present disclosure, there is provided a padlock 100. According to some embodiments of the present disclosure, the padlock 100 may be made from any suitable materials, for example, stainless steel, bronze, brass, silver, alloys, plastics, composite materials or any combination thereof, and may be configured into any suitable shape, for example, disc, rectangle, square, etc. It is understood that the choice of materials or shapes may vary depending upon the desired protection needs against unauthorized use, theft, vandalism, or harm, desired durability, security level, cost and ease of manufacture.

Figure 1:
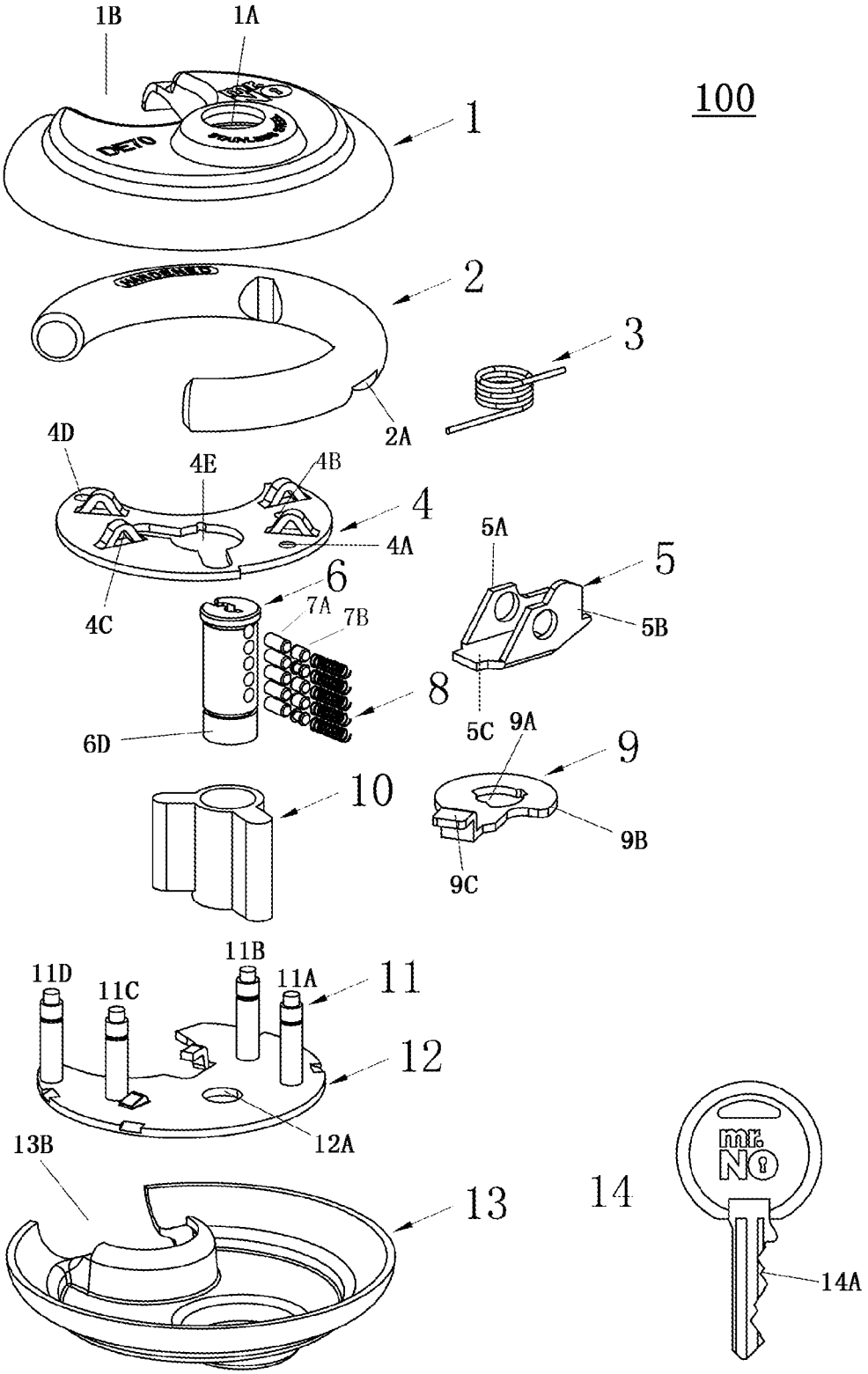
FIG. 1 is a schematic exploded view of the padlock 100 according to an embodiment of the present disclosure.
Figure 2A:
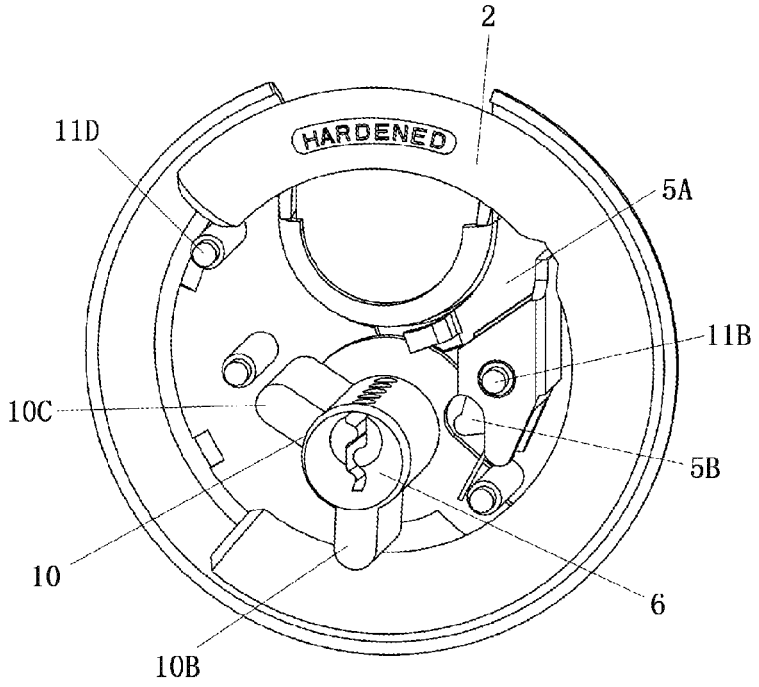
FIG. 2A is a schematic diagram of the padlock 100 in the lock position according to an embodiment of the present disclosure.
Figure 2B:
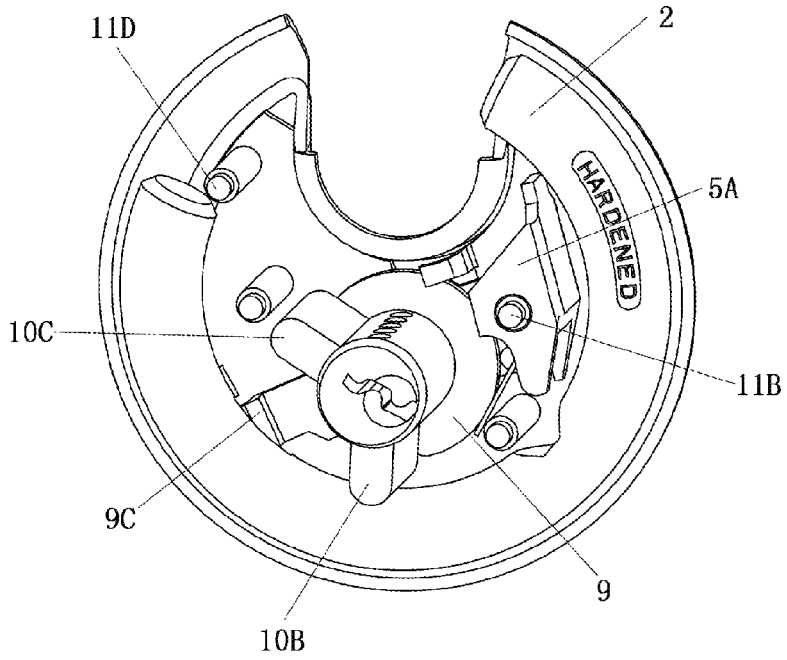
FIG. 2B is a schematic diagram of the padlock 100 in the unlock position according to an embodiment of the present disclosure.

FIG. 1 is a schematic diagram of the padlock 100 according to an embodiment of the present disclosure. As shown in FIG. 1, the padlock 100 comprises a lock cylinder 6 and a lock housing 10. The lock cylinder 6 is rotatable between a lock position as shown in FIG. 2A and an unlock position as shown in FIG. 2B with rotation of a key 14 which has a plurality of teeth 14A. The lock housing 10 comprises a sleeve 10A, a first prong 10B and a second prong 10C in FIGS. 4A and 4B. The sleeve 10A is shaped to fit with and for receiving the lock cylinder 6, so that the lock cylinder 6 is rotatable within the sleeve 10A between the lock position and the unlock position. When the lock cylinder 6 rotates to the lock position, the key 14 is aligned with the first prong 10B and is removable from the padlock 100; and when the lock cylinder 6 rotates to the unlock position, the key 14 is aligned with the second prong 10C and is removable from the padlock 100. The two-prong configuration of the padlock 100 allows the removal of the key in both lock position and unlock position, which will be explained in more details below in combination of the structure of the padlock 100.

Referring to FIG. 1, alternatively, the padlock 100 may further comprise an upper chassis 4 and a bottom chassis 12. The lock cylinder 6 and the lock housing 10 are placed between and held by the upper chassis 4 and the bottom chassis 12. The bottom chassis 12 has an opening 12A allowing a lower end 6D of the lock cylinder 6 to pass through and a plurality of rivets 11A-11D. The upper chassis 4 has a plurality of holes 4A-4D for receiving the rivets and an opening 4E shaped to fit the cross section of the lock housing 10 comprising the sleeve 10A and the first and second recessed portions 10B, 10C. When the lock cylinder 6 rotates between the lock position and the unlock position, the lock housing 10 is fixed relative to the upper chassis 4 and the bottom chassis 12. It is understood that the terms "upper" and "bottom" are merely relative and do not limit the positioning of the padlock to any particular orientation.

Alternatively, the padlock 100 may further comprise a guiding bracket 5 and a latch 9 disposed between the upper chassis 4 and the bottom chassis 12. The guiding bracket 5 comprises an upper plate 5A, a lower plate 5B and a middle plate 5C. The upper plate 5A and lower plate 5B are parallel to each other and each comprises a hole for receiving the rivet 11B of the bottom chassis 12. The middle plate 5C is configured to be between and perpendicular to the upper plate 5A and the lower plate 5B. A spring 3 is disposed around the rivet 11B between the upper plate 5A and lower plate 5B and aligned with the holes of the upper plate 5A and lower plate 5B for receiving the same rivet 11B. One end of the spring 3 is placed against the middle plate 5C and other end is placed against the rivet 11A. Such configuration of the spring 3 generates a tension force in the spring 3, causing the guiding bracket 5 to tend to move clockwise around the rivet 11B. The latch 9 comprises an opening 9A which is shaped to fit the lower end 6D of the lock cylinder 6 and is aligned with the opening 12A of the bottom chassis, a peripheral edge 9B and a projection 9C extending outwards and upwards. When the lock cylinder 6 rotates between the lock position and the unlock position, the latch 9 rotates together with the lock cylinder 6 since the opening 9A is shaped to fit the shape of the lower end 6D of the lock cylinder 6. The peripheral edge 9B of the latch 9 moves against and is pushed by the edge of the lower plate 5B of the guiding bracket 5, due to the tendency of the guiding bracket 5 moving clockwise given by the spring 3. The interaction between the latch 9 and the guiding bracket 5 provides the lock cylinder 6 with guidance for a smooth rotation movement.

Alternatively, the padlock 100 may further comprise a shackle 2 that may be passed through an opening, such as a chain link, or hasp staple. The shackle 2 comprises an indentation 2A for engaging with the projection 9C of the latch 9. When the lock cylinder 6 rotates with the key 14 between the lock position and the unlock position, the shackle 2 rotates together with the latch 9 and the lock cylinder 6, as shown in FIGS. 2A and 2B.

Alternatively, the padlock 100 may further comprise an upper casing 1 and a bottom casing 13 for accommodates the components of the padlock 100 as described above. The upper casing 1 comprises an opening 1A shaped to fit an upper end 6E of the lock cylinder 6, so that the key 14 may be plug in or removed from the lock cylinder through the opening 1A. The upper casing 1 and the bottom casing 13 comprises notches 1B and 13B, respectively, which are aligned with each other for receiving the chain link, hasp staple or the like. When the lock cylinder 6 rotates to the lock position as shown in FIG. 2A, the shackle 2 is positioned across the notches 1B and 13B with one end of the shackle 2 stopped by the rivet 11D. When the lock cylinder 6 rotates to the unlock position as shown in FIG. 2B, the shackle 2 is configured to move out of the notches 1B and 13B and be enclosed entirely within the upper casing 1 and the bottom casing 13, with the other end of the shackle 2 stopped by the rivet 11D.

Figure 3:
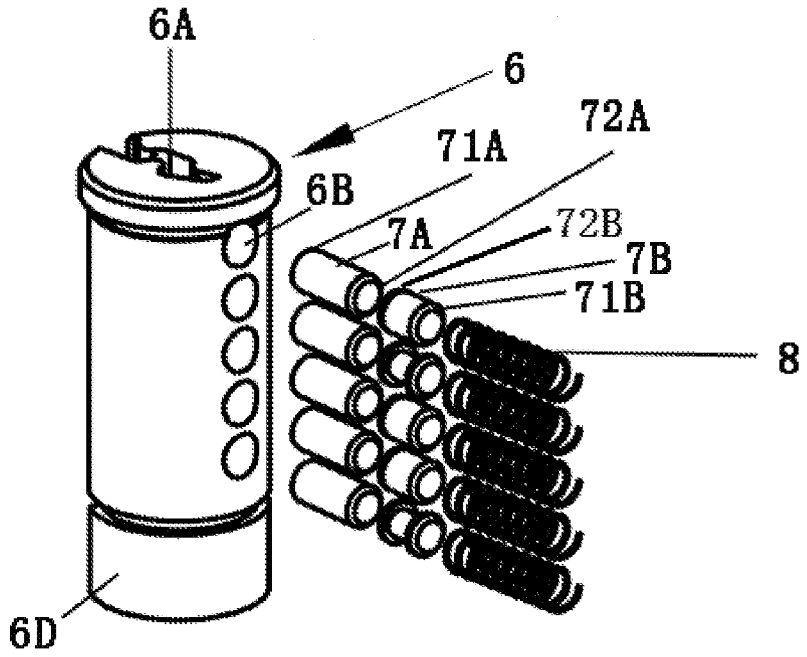
FIG. 3 is a schematic diagram of the lock cylinder according to an embodiment of the present disclosure.

According to some embodiments of the present disclosure, the padlock 100 comprises the lock cylinder 6 and the lock housing 10. The lock cylinder 6 is rotatable between the lock position and the unlock position with rotation of the key 14 and further comprises a keyhole 6A for receiving the key 14 and one or more through holes 6B as shown in FIG. 3. The one or more through holes 6B extend from the keyhole 6A to an outer surface of the lock cylinder 6. The one or more through holes 6B house one or more first pins 7A, respectively. The length of the at least first pins 7A are sized to match the size of the teeth 14A of the key 14, so that when the key 14 is in the keyhole 6A, a proximal end 71A of each first pin 7A contacts with the tooth 14A of the key 14, and a distal end 72A of each first pin 7A is at the outer surface of the lock cylinder 6.

Figure 4A:
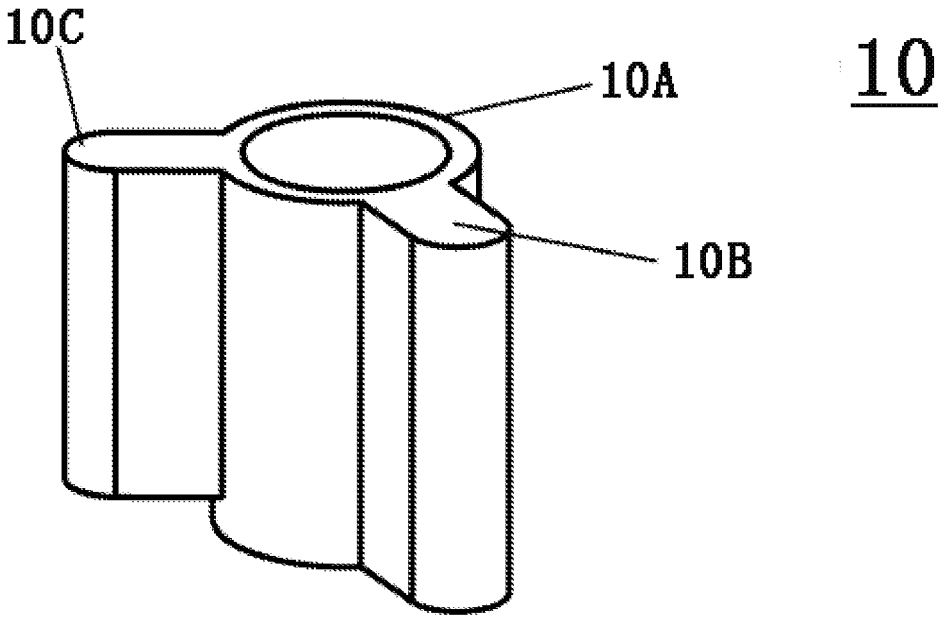
FIG. 4A is a schematic diagram of the lock housing according to an embodiment of the present disclosure.

As shown in FIG. 4A, the lock housing 10 comprises a sleeve 10A, a first prong 10B and a second prong 10C. Optionally, the sleeve 10A, the first prong 10A and the second prong 10B may be formed in an integrated piece. Alternatively, the sleeve 10A, the first prong 10A and the second prong 10B may be formed separately and connected together mechanically, for example, by welding, adhesive, or fasteners, etc. The sleeve 10A is shaped to fit with and for receiving the lock cylinder 6, so that the lock cylinder 6 is rotatable within the sleeve 10A between the lock position and the unlock position. Alternatively, the outer surface of the lock cylinder 6 is in close contact with an inner surface of the sleeve 10A. When the key 14 in the keyhole 6A is not aligned to the lock position or the unlock position, the proximal end 71A of each first pin 7A contacts with the tooth 14A of the key 14, and the distal end 72A of each first pin 7A is at the outer surface of the lock cylinder 6 and reaches the inner surface of the sleeve 10A. If a user is trying to unplug the key 14, the tooth 14A of the key 14 tends to push the proximal end 71A of each first pin 7A outwards. However, when the key 14 in the keyhole 6A is not aligned to the lock position or the unlock position, the distal end 72A of the first pin 7A is stopped by the inner surface of the sleeve 10A, resulting in that the first pin 7A is not movable in the through hole 6B which prevents the key 14 from being removed out of the keyhole 6A.

Referring to FIG. 4A, the first prong 10B extends outwards from the sleeve 10A and has a first recessed portion (not shown); wherein when the lock cylinder 6 is rotated into the lock position as shown in FIG. 2A, the through holes 6B are aligned with the first recessed portion which provides additional room for the one or more first pins 7A, so that the one or more first pins 7A are movable in the space formed by the through holes 6B and the first recessed portion. When a user is unplugging the key 14, the tooth 14A of the key 14 pushes the proximal end 71A of each first pin 7A outwards through the at least through holes 6B into the first recessed portion, providing sufficient room for the key 14 to pass through the keyhole 6A and thus allowing the removal of the key 14 from the keyhole 6A.

The second prong 10C extends outwards from the sleeve 10A and has a second recessed portion (not shown); wherein when the lock cylinder 6 is rotated into the unlock position as shown in FIG. 2B, the through holes 6B are aligned with the second recessed portion which provides additional room for the one or more first pins 7A, so that the one or more first pins 7A are movable in the space formed by through holes 6B and the second recessed portion. When a user is unplugging the key 14, the tooth 14A of the key pushes the proximal end 71A of each first pin 7A outwards through the at least through holes 6B into the second recessed portion, providing sufficient room for the key 14 to pass through the key hole 6A and thus allowing the removal of the key 14 from the keyhole 6A.

According to the present disclosure, the padlock 100 allowing the removal of the key in both lock position and the unlock position, provides convenience to the users and reduces the possibility of inadvertent damage of the padlock, and lowers the cost.

According to some embodiments of the present disclosure, the first prong 10B and the second prong 10C extend outwards radically from the outer surface of the sleeve 10A, respectively. Alternatively, the first prong 10B and/or the second prong 10C may be biased from the radical direction of the sleeve 10A.

According to some embodiments of the present disclosure, an angle formed between the first prong 10B and the second prong 10C is about 120 degrees. When the key 14 rotates in the lock cylinder 6 to the lock position, the key 14 is aligned with the first prong 10B and is removable from the padlock 100, as shown in FIG. 2A. When the key 14 rotates about 120 degrees in the lock cylinder 6 to the unlock position, the key 14 is aligned with the second prong 10C and is removable from the padlock 100, as shown in FIG. 2B. Alternatively, the first prong 10B and the second prong 10C may form a different angle depending on the desired needs.

According to some embodiments of the present disclosure, the first prong 10B and/or the second prong 10C extend axially across an entire length of the sleeve 10A. Alternatively, one of the prongs, such as the first prong 10B, extends axially across an entire length of the sleeve 10A, as shown in FIG. 4A. Alternatively, both of the prongs extend axially across an entire length of the sleeve 10A. Such configuration, where the first prong 10B and/or the second prong 10C extend axially across an entire length of the sleeve 10A, enhances the mechanical strength of the joints between the sleeve 10A and the first prong 10B and/or the second prong 10C, and improves the durability of the padlock 100.

Figure 4B:
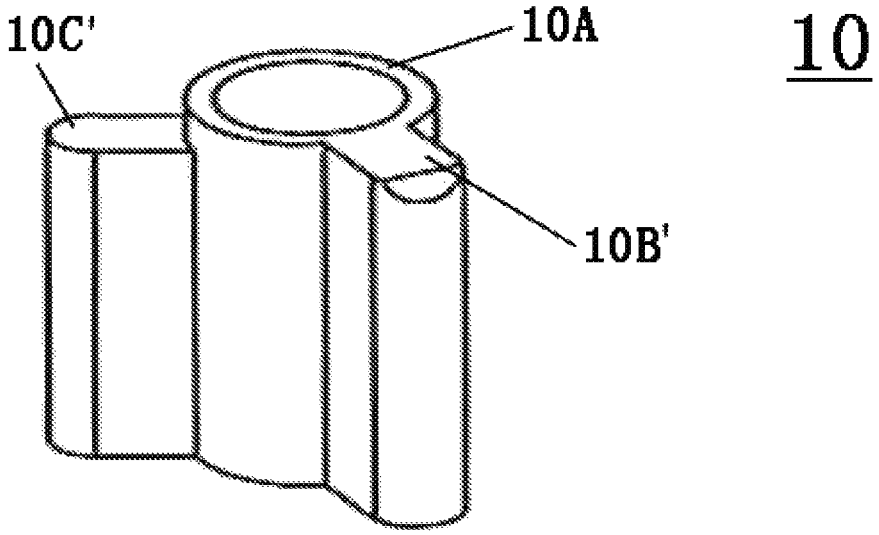
FIG. 4B is a schematic diagram of the lock housing according to a further embodiment of the present disclosure.

According to some embodiments of the present disclosure, the first prong 10B' and/or the second prong 10C' extend axially across part of a length of the sleeve 10A. Alternatively, one of the prongs, such as the first prong 10C', extends axially across part of a length of the sleeve 10A, as shown in FIG. 4B. Alternatively, both of the prongs extend axially across part of a length of the sleeve 10A. Such configuration, where the first prong 10B' and/or the second prong 10C' extend axially across part of a length of the sleeve 10A, enables the structure of the lock housing 10 to be more compact and sparing more room for other components of the padlock 100, reduces the amount of the raw material needed and thus lower the costs.

According to some embodiments of the present disclosure, the first recessed portion and the second recessed portion each comprises one or more holes for housing one or more second pins 7B and one or more springs 8, respectively; wherein a distal end 71B of each second pin 7B contacts with the respective spring 8 and a proximal end 72B of each second pin 7B contacts with the lock cylinder 6. Alternatively, when the key 14 is neither aligned with the first prong 10B in the lock position nor aligned with the second prong 10C in the unlock position, the proximal end 72B of each second pin 7B contacts with the outer surface of the lock cylinder 6. Alternatively, when the key 14 is aligned with the first prong 10B in the lock position or aligned with the second prong 10C in the unlock position, the proximal end 72B of each second pin 7B contacts with the distal end 72A of each first pin 7A of the lock cylinder 6.

As shown in FIG. 2A, when the lock cylinder 6 is rotated into the lock position, the through holes 6B are aligned with the first recessed portion in the first prong 10B which comprises one or more holes for housing one or more second pins 7B and one or more springs 8. If a user is trying to unplug the key 14, the tooth 14A of the key tends to push the proximal end 71A of each first pin 7A outwards. The distal end 72A of each first pin 7A pushes the proximal end 72B of each second pin 7B, and the distal end 71B pushes the respective spring 8. The spring 8 is compressed by the force from the distal end 71B of each second pin 7B, providing additional room for the one or more first pins 7A and the at least second pins 7B, so that the one or more first pins 7A are movable in the space formed by the through holes 6B and the first recessed portion. When a user is unplugging the key 14, the tooth 14A of the key pushes the proximal end 71A of each first pin 7A outwards through the at least through holes 6B into the first recessed portion, providing sufficient room for the key 14 to pass through the keyhole 6A and thus allowing the removal of the key 14 from the keyhole 6A.

Similarly, as shown in FIG. 2B, when the lock cylinder 6 is rotated into the unlock position, the through holes 6B are aligned with the second recessed portion in the second prong 10B which comprises one or more holes for housing one or more second pins 7B and one or more springs 8. If a user is trying to unplug the key 14, the tooth 14A of the key tends to push the proximal end 71A of each first pin 7A outwards. The distal end 72A of each first pin 7A pushes the proximal end 72B of each second pin 7B, and the distal end 71B pushes the respective spring 8. The spring 8 is compressed by the force from the distal end 71B of each second pin 7B, providing additional room for the one or more first pins 7A and the at least second pins 7B, so that the one or more first pins 7A are movable in the space formed by the through holes 6B and the second recessed portion. When a user is unplugging the key 14, the tooth 14A of the key pushes the proximal end 71A of each first pin 7A outwards through the at least through holes 6B into the second recessed portion, providing sufficient room for the key 14 to pass through the keyhole 6A and thus allowing the removal of the key 14 from the keyhole 6A.

Alternatively, the first recessed portion and the second recessed portion each may comprise other parts which is elastic and can be deformed or compressed upon pressure to provide additional room for the removal of the key, for example, rubber columns, etc.

According to some embodiments of the present disclosure, the one or more through holes 6B of the lock cylinder 6 are 4 to 7 through holes; and the one or more first pins 7A are 4 to 7 first pins.

According to some embodiments of the present disclosure, the one or more holes of the first prong 10B or second prong 10C are 4 to 7 holes; the one or more second pins 7B are 4 to 7 second pins; and the one or more springs 8 are 4 to 7 springs.

With 4 to 7 through holes and first pins, or with 4 to 7 holes, second pins and springs, the padlock 100 achieves high level of security and meanwhile low costs.

According to some embodiments of the present disclosure, the distal end 72A of each first pin 7A is flat headed, as shown in FIG. 3. When a user is trying to unplug the key 14, the tooth 14A of the key tends to push the proximal end 71A of each first pin 7A outwards. The distal end 72A of each first pin 7A pushes the proximal end 72B of each second pin 7B, to exert pushing force to the spring 8 to compress the spring 8, providing additional room for the one or more first pins 7A and the at least second pins 7B, so that the one or more first pins 7A are movable in the space formed by the through holes 6B and the first recessed portion. The flat headed distal end 72A of each first pin 7A enables the pushing force to be applied to the proximal end 72B of each second pin 7B steadily, and thus increases security and reliability of the padlock 100.

According to some embodiments of the present disclosure, the proximal end 71A of each first pin 7A is tapered. When the key 14 is aligned with the first prong 10B in the lock position or with the second prong 10C in the unlock position, a user is unplugging the key 14, the key 14 is removable from the keyhole 6A. The tapered proximal end 71A of each first pin 7A contacting the teeth 14A of the key 14 facilitates a smooth and easy removal movement of the key 14, reduces the chances that the key 14 is damaged during removal from the keyhole and thus improves the durability of the padlock 100.

In conclusion, various embodiments of the present disclosure provide a two-prong padlock with improved security and convenience, which allows the removal of the key in both lock position and unlock position, provides convenience to the users, reduces the possibility that the key is broken and stuck inside the padlock causing the padlock no long to be functional, improves the durability and reliability of the padlock, achieves high level of security and lowers the cost.

It should be noted that the aforesaid embodiments are exemplary rather than limiting the present disclosure, substitute an alternative embodiments may be designed by those skilled in the art without departing from the scope of the claims enclosed. The word "include" does not exclude elements or steps which are present but not listed in the claims. The word "a" or "an" preceding the elements does not exclude the presence of a plurality of such elements. In the apparatus claims that list several components, several ones among these components can be specifically embodied in the same hardware item. The use of such words as first, second, third does not represent any order, which can be simply explained as names.

The invention claimed is:

1. A padlock, comprising:

a lock cylinder, rotatable between a lock position and an unlock position with rotation of a key, comprising:

a keyhole for receiving the key having a plurality of teeth; and one set of through holes extending from the keyhole to an outer surface of the lock cylinder for housing one set of first pins, respectively, wherein said one set of through holes and said one set of first pins arranged along one same line in a longitudinal direction of the lock cylinder; wherein, when the key is in the keyhole, a proximal end of each first pin contacts with a tooth of the key, and a distal end of each first pin is at the outer surface of the lock cylinder; and a lock housing, comprising:

a sleeve shaped to fit with, and for receiving, the lock cylinder;

a first prong extending outward from the sleeve and having a first recessed portion; wherein when the lock cylinder is rotated into the lock position, said one set of through holes are aligned with the first recessed portion, said one set of first pins are movable in said one set of through holes and the first recessed portion, allowing the removal of the key from the keyhole; and a second prong extending outward from the sleeve and having a second recessed portion; wherein when the lock cylinder is rotated into the unlock position, said one set of through holes are aligned with the second recessed portion, said one set of first pins are movable in said one set of through holes and the second recessed portion, allowing the removal of the key from the keyhole, wherein one of the first prong and the second prong extends axially across an entire length of the sleeve, and the other one of the first prong and the second prong extends axially across a part of, and less than the entire length of, the sleeve.

2. The padlock according to claim 1, wherein the first prong and the second prong extend outward radially from an outer surface of the sleeve, respectively.

3. The padlock according to claim 1, wherein an angle formed between the first prong and the second prong is about 120 degrees.

4. The padlock according to claim 1, wherein the first recessed portion and the second recessed portion each comprise one or more holes for housing one or more second pins and one or more springs, respectively; wherein a distal end of each second pin contacts with the respective spring and a proximal end of each second pin contacts with the lock cylinder.

5. The padlock according to claim 1, wherein the one set of through holes comprises 4 to 7 through holes; and the one set of first pins comprises 4 to 7 first pins.

6. The padlock according to claim 4, wherein the one or more holes comprise 4 to 7 holes; the one or more second pins comprise 4 to 7 second pins; and the one or more springs comprise 4 to 7 springs.

7. The padlock according to claim 1, wherein the distal end of each first pin is flat headed.

8. The padlock according to claim 1, wherein the proximal end of each first pin is tapered.

* * * * *